US007711487B2

(12) United States Patent
Surjaatmadja

(10) Patent No.: US 7,711,487 B2
(45) Date of Patent: May 4, 2010

(54) METHODS FOR MAXIMIZING SECOND FRACTURE LENGTH

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/753,314

(22) Filed: May 24, 2007

(65) Prior Publication Data

US 2008/0083532 A1 Apr. 10, 2008

Related U.S. Application Data

(63) Continuation-in-part of application No. 11/545,749, filed on Oct. 10, 2006.

(51) Int. Cl.
*G01V 9/00* (2006.01)

(52) U.S. Cl. ..... 702/11

(58) Field of Classification Search ..... 702/11, 702/34, 35, 176, 14, 18, 36, 39, 56, 79; 166/250.1, 166/308.1, 177.5
See application file for complete search history.

(56) References Cited

U.S. PATENT DOCUMENTS

| | | | | |
|---|---|---|---|---|
| 2,758,653 | A | 8/1956 | Desbrow | |
| 2,953,460 | A | 9/1960 | Baker | |
| 2,980,291 | A | 4/1961 | Schuerger | |
| 3,062,286 | A | 11/1962 | Wyllie | |
| 3,455,391 | A | 7/1969 | Matthews et al. | 166/303 |
| 3,537,529 | A | 11/1970 | Timmerman | |
| 3,682,246 | A | 8/1972 | Closmann | 166/271 |
| 3,822,747 | A | 7/1974 | Maguire, Jr. | 166/259 |
| 3,933,205 | A | 1/1976 | Kiel | |
| 4,050,529 | A | 9/1977 | Tagirov et al. | |
| 4,137,970 | A | 2/1979 | Laflin et al. | 166/292 |
| 4,209,278 | A | 6/1980 | Cooper et al. | 417/477 |
| 4,265,266 | A | 5/1981 | Kierbow et al. | 137/101.19 |

(Continued)

FOREIGN PATENT DOCUMENTS

EP 0124251 11/1984

(Continued)

OTHER PUBLICATIONS

SPE 103774 "Consideration for Future Stimulation Options is Vital in Deciding Horizontal Well Drilling and Completion Schemes for Production Optimization". 2006.*

(Continued)

*Primary Examiner*—Michael P Nghiem
(74) *Attorney, Agent, or Firm*—Robert A. Kent

(57) ABSTRACT

The present invention relates to methods, systems, and apparatus for inducing fractures in a subterranean formation and more particularly to methods and apparatus to place a first fracture with a first orientation in a formation followed by a second fracture with a second angular orientation in the formation. The first and second fractures are initiated at about a fracturing location. The initiation of the first fracture is characterized by a first orientation line. The first fracture temporarily alters a stress field in the subterranean formation. The initiation of the second fracture is characterized by a second orientation line. The first orientation line and the second orientation line have an angular disposition to each other.

7 Claims, 18 Drawing Sheets

U.S. PATENT DOCUMENTS

| | | | | |
|---|---|---|---|---|
| 4,305,463 | A | 12/1981 | Zakiewicz | 166/245 |
| 4,353,482 | A | 10/1982 | Tomlinson et al. | 222/1 |
| 4,409,927 | A | 10/1983 | Loesch et al. | 122/26 |
| 4,410,106 | A | 10/1983 | Kierbow et al. | |
| 4,427,133 | A | 1/1984 | Kierbow et al. | |
| 4,701,095 | A | 10/1987 | Berryman et al. | |
| 4,715,721 | A | 12/1987 | Walker et al. | |
| 4,724,905 | A | 2/1988 | Uhri | 166/250 |
| 4,733,567 | A | 3/1988 | Serata | |
| 4,830,106 | A | 5/1989 | Uhri | 166/250 |
| 4,845,981 | A | 7/1989 | Pearson | |
| 4,850,750 | A | 7/1989 | Cogbill et al. | |
| 4,974,675 | A | 12/1990 | Austin et al. | |
| 5,014,218 | A | 5/1991 | Crain et al. | 700/9 |
| 5,111,881 | A | 5/1992 | Soliman et al. | |
| 5,228,510 | A | 7/1993 | Jennings, Jr. et al. | 166/263 |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A | 2/1996 | Surjaatmadja et al. | |
| 5,499,678 | A | 3/1996 | Surjaatmadja et al. | |
| 5,515,920 | A | 5/1996 | Luk et al. | 166/280.1 |
| 5,574,218 | A * | 11/1996 | Withers | 73/152.02 |
| 5,659,480 | A | 8/1997 | Anderson et al. | 700/186 |
| 6,120,175 | A | 9/2000 | Tewell | |
| 6,193,402 | B1 | 2/2001 | Grimland et al. | 366/14 |
| 6,236,894 | B1 | 5/2001 | Stoisits et al. | |
| 6,394,184 | B2 | 5/2002 | Tolman et al. | 166/281 |
| 6,575,247 | B2 | 6/2003 | Tolman et al. | |
| 6,644,844 | B2 | 11/2003 | Neal et al. | |
| 6,729,394 | B1 | 5/2004 | Hassan et al. | |
| 6,935,424 | B2 | 8/2005 | Lehman et al. | 166/250.1 |
| 6,991,037 | B2 | 1/2006 | Hocking | |
| 7,036,587 | B2 | 5/2006 | Munoz et al. | 166/279 |
| 7,143,842 | B2 | 12/2006 | Ikuta | 173/201 |
| 7,225,869 | B2 | 6/2007 | Willett et al. | |
| 7,243,726 | B2 | 7/2007 | Ohmer | |
| 7,367,411 | B2 | 5/2008 | Leuchtenberg | |
| 7,391,675 | B2 | 6/2008 | Drew | |
| 7,431,090 | B2 | 10/2008 | Surjaatmadja et al. | |
| 7,445,045 | B2 | 11/2008 | East, Jr. et al. | |
| 2002/0125011 | A1 | 9/2002 | Snider et al. | |
| 2003/0050758 | A1 * | 3/2003 | Soliman et al. | 702/6 |
| 2003/0141064 | A1 | 7/2003 | Roberson, Jr. | |
| 2004/0020662 | A1 | 2/2004 | Freyer | 166/387 |
| 2005/0121196 | A1 | 6/2005 | East, Jr. et al. | |
| 2005/0211439 | A1 | 9/2005 | Willett et al. | |
| 2006/0081412 | A1 * | 4/2006 | Wright et al. | 181/104 |
| 2006/0161358 | A1 | 7/2006 | Dykstra et al. | 702/55 |
| 2006/0185848 | A1 | 8/2006 | Surjaatmadja et al. | |
| 2006/0289167 | A1 * | 12/2006 | Surjaatmadja et al. | 166/308.1 |
| 2007/0116546 | A1 | 5/2007 | Dearing | |
| 2007/0125543 | A1 | 6/2007 | McNeel et al. | 166/308.3 |
| 2007/0125544 | A1 | 6/2007 | Robinson et al. | 166/308.3 |
| 2007/0153622 | A1 | 7/2007 | Dykstra et al. | 366/8 |
| 2007/0153623 | A1 | 7/2007 | Dykstra et al. | 366/8 |
| 2007/0153624 | A1 | 7/2007 | Dykstra et al. | 366/19 |
| 2007/0171765 | A1 * | 7/2007 | Dykstra et al. | 366/19 |
| 2007/0201305 | A1 * | 8/2007 | Heilman et al. | 366/141 |
| 2008/0083531 | A1 * | 4/2008 | Surjaatmadja | 166/250.1 |
| 2008/0083532 | A1 | 4/2008 | Surjaatmadja | 166/250.1 |
| 2008/0083538 | A1 * | 4/2008 | Soliman | 166/308.1 |
| 2008/0236818 | A1 | 10/2008 | Dykstra | |
| 2009/0050311 | A1 | 2/2009 | Crawford | |
| 2009/0194273 | A1 | 8/2009 | Surjaatmadja | |

FOREIGN PATENT DOCUMENTS

| | | | |
|---|---|---|---|
| EP | 0 474 3530 | A1 | 7/1991 |
| EP | 0508817 | | 10/1992 |
| GB | 1 460 647 | * | 1/1977 |
| GB | 1460647 | | 1/1977 |
| NO | 20042134 | | 5/2004 |
| WO | WO 2004/007894 | | 1/2004 |
| WO | WO 2006/109035 | A | 10/2006 |
| WO | WO 2007/024383 | | 3/2007 |
| WO | 2008/041010 | * | 4/2008 |
| WO | WO 2008/041010 | A1 | 4/2008 |
| WO | 2008/142406 | * | 11/2008 |

OTHER PUBLICATIONS

Warpinski, Norman R and Branagan, Paul T., "Altered Stress Fracturing", JPT (Sep. 1989), 990-97, 473-476.
Surjaatmadja, "Single Point of Initiation, Dual-Fracture Placement for Maximizing Well Production," Society of Petroleum Engineers, SPE 107718, 2007.
Surjaatmadja, "The Important Second Fracture and its Operational Placement for Maximizing Production," Society of Petroleum Engineers, SPE 107059, 2007.
Surjaatmadja, "The Mythical Second Fracture and its Operational Placement for Maximizing Production," Society of Petroleum Engineers, SPE 106046, 2007.
U.S. Appl. No. 11/545,749, filed Oct. 10, 2006, Surjaatmadja.
Information Disclosure Statement for U.S. Appl. No. 11/291,496, Nov. 21, 2006.
Office Action for U.S. Appl. No. 11/396,918, May 3, 2007.
Office Action for U.S. Appl. No. 11/291,496, May 3, 2007.
International Search Report for International Application No. PCT/GB2007/000677, Jun. 11, 2007.
International Search Report for International Application No. PCT/GB2007/001189, Sep. 5, 2007.
Information Disclosure Statement for U.S. Appl. No. 11/396,918, Oct. 15, 2007.
Office Action for U.S. Appl. No. 11/291,496, Oct. 16, 2007.
Information Disclosure Statement for U.S. Appl. No. 11/873,160, Oct. 16, 2007.
Information Disclosure Statement for U.S. Appl. No. 11/873,186, Oct. 16, 2007.
Office Action for U.S. Appl. No. 11/396,918, Jan. 25, 2008.
International Search Report for International Application No. PCT/GB2008/001044, Aug. 13, 2008.
Office Action for U.S. Appl. No. 11/291,496, Aug. 21, 2008.
Office Action for U.S. Appl. No. 11/873,186, Sep. 24, 2008.
Notice of Publication for U.S. Appl. No. 11/691,623, Oct. 2, 2008.
Office Action for U.S. Appl. No. 11/363,559 mailed Jan. 23, 2009.
Office Action for U.S. Appl. No. 11/291,496, dated Mar. 11, 2009.
Office Action for U.S. Appl. No. 11/396,918 dated Oct. 15, 2008.
Search Report and Written Opinion for International Application No. PCT/GB2008/001730, May 21, 2008.
Office Action for U.S. Appl. No. 11/545,749, mailed Feb. 10, 2009.
Office Action for U.S. Appl. No. 11/873,186, dated Oct. 5, 2009.
Office Action for U.S. Appl. No. 11/873,160, dated Oct. 1, 2009.
International Preliminary Report on Patentability from PCT/GB2008/001044, dated Oct. 8, 2009.
Office Action for U.S. Appl. No. 11/396,918, dated Apr. 29, 2009.
Office Action for U.S. Appl. No. 11/545,749, dated May 1, 2009.
Office Action for U.S. Appl. No. 11/691,623, dated Jul. 9, 2009.
Office Action for U.S. Appl. No. 11/291,496, dated May 19, 2009.
Office Action for U.S. Appl. No. 11/396,918, dated Dec 1, 2009.
Office Action for U.S. Appl. No. 11/873,186, dated Jan 25, 2010.
Office Action for U.S. Appl. No. 11/545,749, dated Jan 27, 2010.

* cited by examiner

METHODS FOR MAXIMIZING SECOND FRACTURE LENGTH

CROSS-REFERENCE TO RELATED APPLICATIONS

This application is a continuation in part of U.S. patent application Ser. No. 11/545,749 filed on Oct. 10, 2006 which is hereby incorporated by reference as if fully reproduced herein.

BACKGROUND

The present invention relates generally to methods for inducing fractures in a subterranean formation and more particularly to methods to place a first fracture with a first orientation in a formation followed by a second fracture with a second angular orientation in the formation according to a time determination.

Oil and gas wells often produce hydrocarbons from subterranean formations. Occasionally, it is desired to add additional fractures to an already-fractured subterranean formation. For example, additional fracturing may be desired for a previously producing well that has been damaged due to factors such as fine migration. Although the existing fracture may still exist, it is no longer effective, or less effective. In such a situation, stress caused by the first fracture continues to exist, but it would not significantly contribute to production. In another example, multiple fractures may be desired to increase reservoir production. This scenario may also be used to improve sweep efficiency for enhanced recovery wells such as water flooding steam injection, etc. In yet another example, additional fractures may be created to inject with drill cuttings.

Conventional methods for initiating additional fractures typically induce the additional fractures with near-identical angular orientation to previous fractures. While such methods increase the number of locations for drainage into the wellbore, they may not introduce new directions for hydrocarbons to flow into the wellbore. Conventional method may also not account for, or even more so, utilize, stress alterations around existing fractures when inducing new fractures.

Thus, a need exists for an improved method for initiating multiple fractures in a wellbore, where the method accounts for tangential forces around a wellbore and the timing of inducing a subsequent fracture.

SUMMARY

The present invention relates generally to methods, systems and apparatus for inducing fractures in a subterranean formation and more particularly to methods to place a first fracture with a first orientation in a formation followed by a second fracture with a second angular orientation in the formation at a specified time determination.

An example method of the present invention is for fracturing a subterranean formation. The subterranean formation includes a wellbore having an axis. A first fracture is induced in the subterranean formation. The first fracture is initiated at about a fracturing location. The initiation of the first fracture is characterized by a first orientation line. The first fracture temporarily alters a stress field in the subterranean formation. A second fracture is induced, after a time delay, in the subterranean formation. The second fracture is initiated at about the fracturing location. The initiation of the second fracture is characterized by a second orientation line. The first orientation line and the second orientation line have an angular disposition to each other.

An example fracturing tool according to present invention includes a tool body to receive a fluid, the tool body comprising a plurality of fracturing sections, wherein each fracturing section includes at least one opening to deliver the fluid into the subterranean formation at an angular orientation; and a sleeve disposed in the tool body to divert the fluid to at least one of the fracturing sections while blocking the fluid from exiting another at least one of the fracturing sections. Another example of a fracturing tool according to the present invention includes a tool body to receive a fluid, the tool body comprising one fracturing section, which includes at least one opening to deliver the fluid into the subterranean formation at an angular orientation, wherein the direction change is provided by rotating or moving the tool.

An example system for fracturing a subterranean formation according to the present invention includes a downhole conveyance selected from a group consisting of a drill string and coiled tubing, wherein the downhole conveyance is at least partially disposed in the wellbore; a drive mechanism configured to move the downhole conveyance in the wellbore; a pump coupled to the downhole conveyance to flow a fluid though the downhole conveyance; and a computer configured to control the operation of the drive mechanism and the pump. The computer comprises one or more processors and a memory. The memory comprises executable instructions that, when executed, cause the one or more processors to determine the time delay between inducing the first fracture and inducing a second fracture, wherein the time delay is determined based, at least in part, on one or more stress fields of one or more affected layers during opening or closing of the fracture.

The fracturing tool includes tool body to receive the fluid, the tool body comprising a plurality of fracturing sections, wherein each fracturing section includes at least one opening to deliver the fluid into the subterranean formation at an angular orientation and a sleeve disposed in the tool body to divert the fluid to at least one of the fracturing sections while blocking the fluid from exiting another at least one of the fracturing sections.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates generally to methods, systems, and apparatus for inducing fractures in a subterranean formation and more particularly to methods and apparatus to place a first fracture with a first orientation in a formation followed by a second fracture with a second angular orientation in the formation. Furthermore, the present invention may be used on cased well bores or open holes.

The methods and apparatus of the present invention may allow for increased well productivity by the introduction of multiple fractures at different angles relative to one another in a wellbore.

Figure 1:
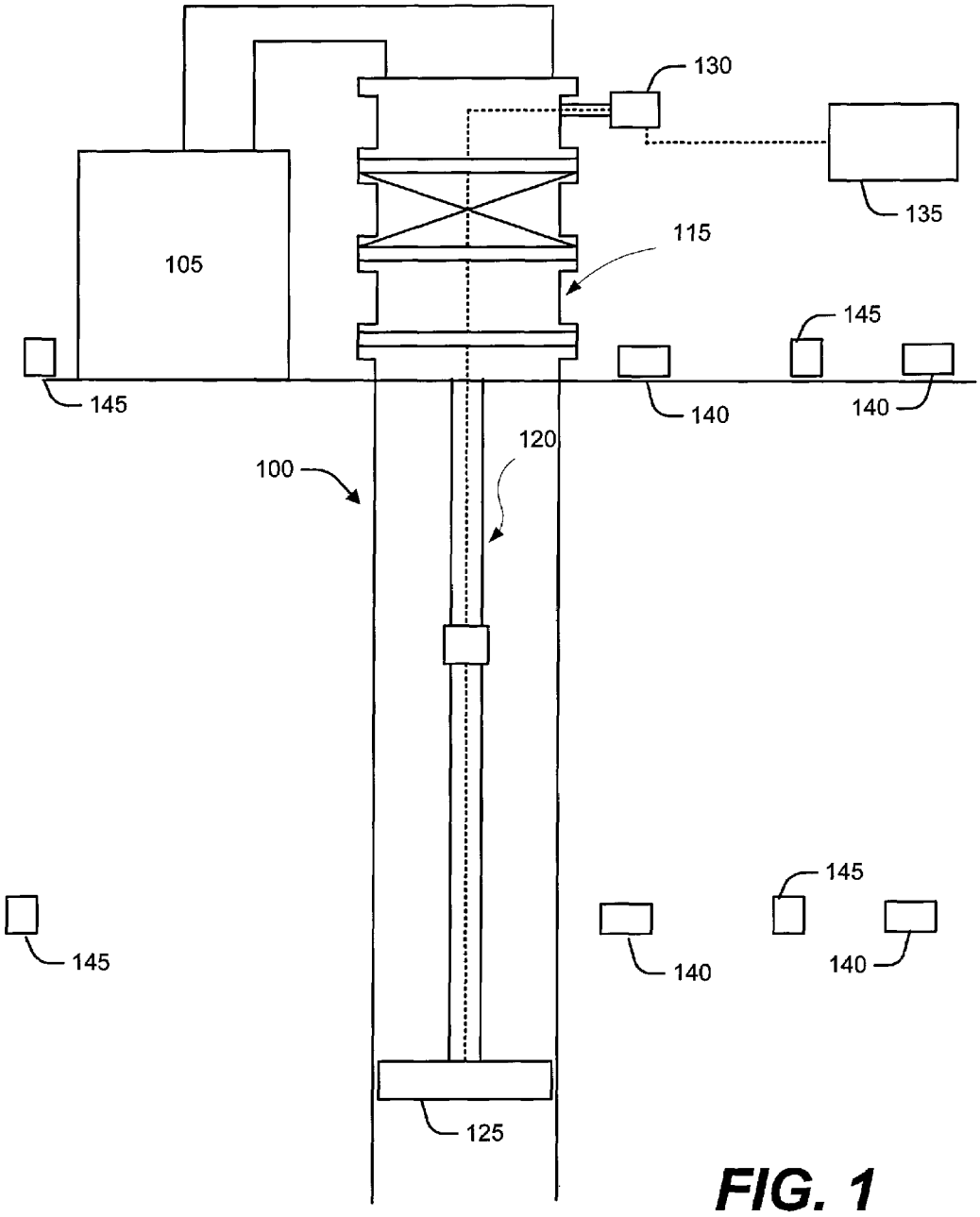
FIG. 1 is a schematic block diagram of a wellbore and a system for fracturing.

FIG. 1 depicts a schematic representation of a subterranean well bore 100 through which a fluid may be injected into a region of the subterranean formation surrounding well bore 100. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 100 and generates pressure signals. The fluid may be injected by injection device 105 (e.g., a pump). At wellhead 115, a downhole conveyance device 120 is used to deliver and position a fracturing tool 125 to a location in the wellbore 100. In some example implementations, the downhole conveyance device 120 may include coiled tubing. In other example implementations, downhole conveyance device 120 may include a drill string that is capable of both moving the fracturing tool 125 along the wellbore 100 and rotating the fracturing tool 125. The downhole conveyance device 120 may be driven by a drive mechanism 130. One or more sensors may be affixed to the downhole conveyance device 120 and configured to send signals to a control unit 135.

The control unit 135 is coupled to drive unit 130 to control the operation of the drive unit. The control unit 135 is coupled to the injection device 105 to control the injection of fluid into the wellbore 100. The control unit 135 includes one or more processors and associated data storage. In one example embodiment, control unit 135 may be a computer comprising one or more processors and a memory. The memory includes executable instructions that, when executed, cause the one or more processors to determine the time delay between inducing the first fracture and inducing the second fracture. In certain example implementations, the time delay between the inducement of the first fracture and the inducement of the second fracture is based, at least in part, on physical measurements. In certain example implementations, the time delay between the inducement of the first fracture and the inducement of the second fracture is based, at least in part, on simulation data. In one embodiment, the control unit 135 determines the time delay based, at least in part, on one or more stress fields of one or more affected layers of the formation that are altered during the opening and closing of the first fracture.

Stress fields in one or more layers of the formation that are altered by the first fracture may be measured using one or more devices. In certain embodiments, one or more tilt meters 140 are placed at the surface and are configured to generate one or more outputs. The outputs of the tilt meters are indicative of the magnitudes and orientations of the stress fields. In other example implementations, the one or more tilt meters 140 are disposed in the subterranean formation. For example, the tilt meters 140 may be displaced in the formation at a location near the fracturing level. The outputs from the tilt meters 140 during the opening or closing of the first fracture are relayed to the control unit 135. As mentioned above, the control unit 135 may determine the time delay based, at least in part, on one or more of these tilt meter outputs.

In other example systems, a plurality of microseismic receivers 145 are placed in an observation well. These microseismic receivers 145 are configured to generate one or more outputs based on measured stress fields of one or more affected layers. In one example implementation, the microseismic receivers 145 are placed in the observation well at a depth that is close enough to the level of fracturing to produce meaningful output. Microseismic receivers 145 may also be placed at about the surface. Outputs of the microseismic receivers 145 are received by the control unit 135. The outputs of the microseismic receivers 145 include outputs generated during one or more of the opening and closing of the first fracture. In general, the microseismic receivers 145 listen to signals that may be characterized as "microseisms" or "snaps" when microcracks are occurring. The received signals of these "snaps" are received at multiple microseismic receivers. The system then triangulates the received "snaps" to determine a location from which the signals originated. In certain example implementations, the time delay is determined based, at least in part, on the one or more outputs of the microseismic receivers 145. In certain example implementations, outputs from tilt meters, discussed above, are used in combination with the outputs from the microseismic receivers 145 to determine the time delay.

In some example implementations, the measured stress fields are used to determine one or more of stick-slip velocity, Maxwell creep, and pseudo-Maxwell creep. In some example implementations, the one or more of stick-slip velocity, Maxwell creep, and pseudo-Maxwell creep are, in turn, used to determine the time delay between the inducement of the first fracture and the inducement of the second fracture.

In some implementations, other formation characteristics of the formation that are measured during fracturing are used to determine the time delay. In certain example implementations, the control unit 135 determines the length of fracture of the first fracture in one or more of an inward and outward direction, based, at least in part, on the stress fields. In certain example implementations, the control unit 135 determines the stress change of a wavefront of the first fracture based, at least in part, on the stress fields. In some example implementations, the time delay is based on one or more of these other formation characteristics.

In certain example implementations, the one or more processors of control unit 135 are configured to monitor one or more of the extension of the first fracture and the expansion effect velocity of the first fracture. In certain example implementations, the one or more processors determine the time delay based, at least in part, on one or more of the monitored extension of the first fracture and the expansion effect velocity of the first fracture.

In other embodiments, the control unit 135 controls the pumping of the treatment fluid, which, in turn, controls a fracture extension velocity of one or more of the first and second fractures. In some example implementations, the pumping of the treatment fluid is controlled to prevent a fracture tip of the second fracture from advancing beyond one or more of a stick-slip front of the first fracture and a Maxwell creep front of the first fracture. In this instance, the fracture tip velocity of the second fracture may be simulated by the one or more processors. In other example implementations, the fracture tip velocity of the second fracture may be determined based, at least in part, on historical data from other fracturing operations.

Figure 2A:
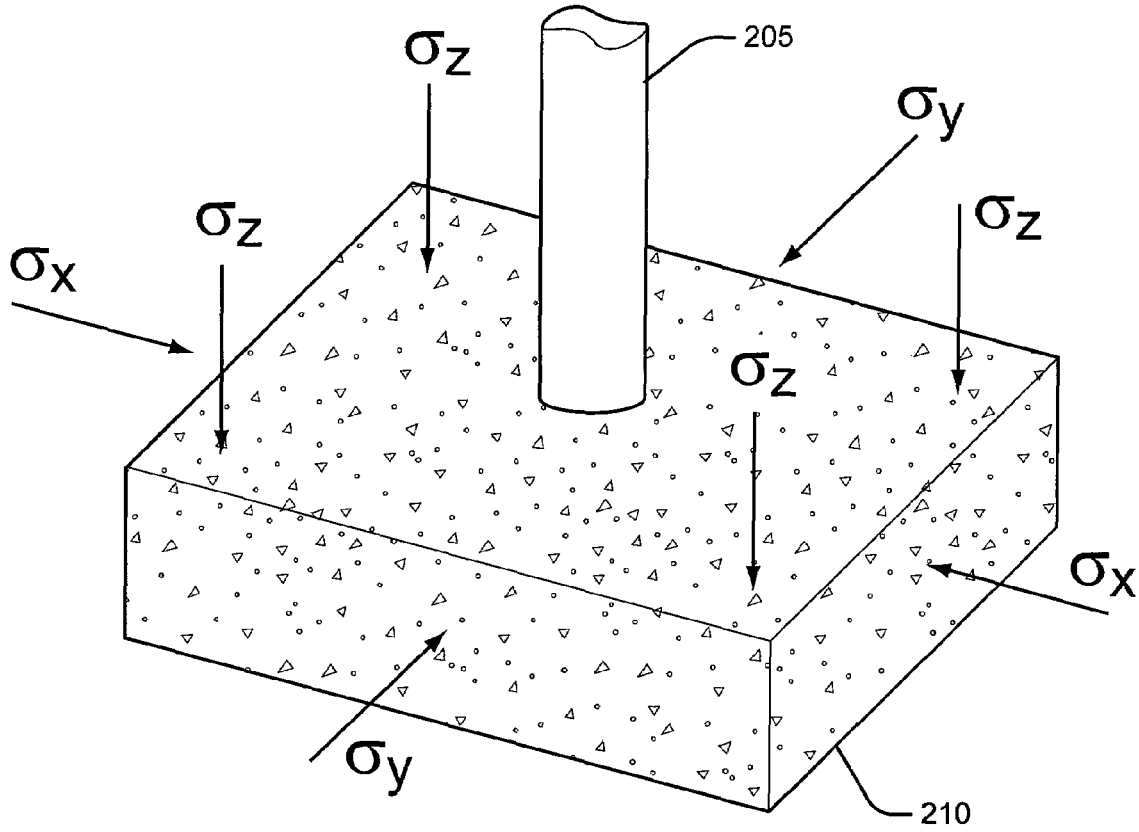
FIG. 2A is a graphical representation of a wellbore in a subterranean formation and the principal stresses on the formation.

FIG. 2 is an illustration of a wellbore 205 passing though a formation 210 and the stresses on the formation. In general, formation rock is subjected by the weight of anything above it, i.e. $\sigma_z$ overburden stresses. By Poisson's rule, these stresses and formation pressure effects translate into horizontal stresses $\sigma_x$ and $\sigma_y$. In general, however, Poisson's ratio is not consistent due to the randomness of the rock. Also, geological features, such as formation dipping may cause other stresses. Therefore, in most cases, $\sigma_x$ and $\sigma_y$ are different.

Figure 2B:
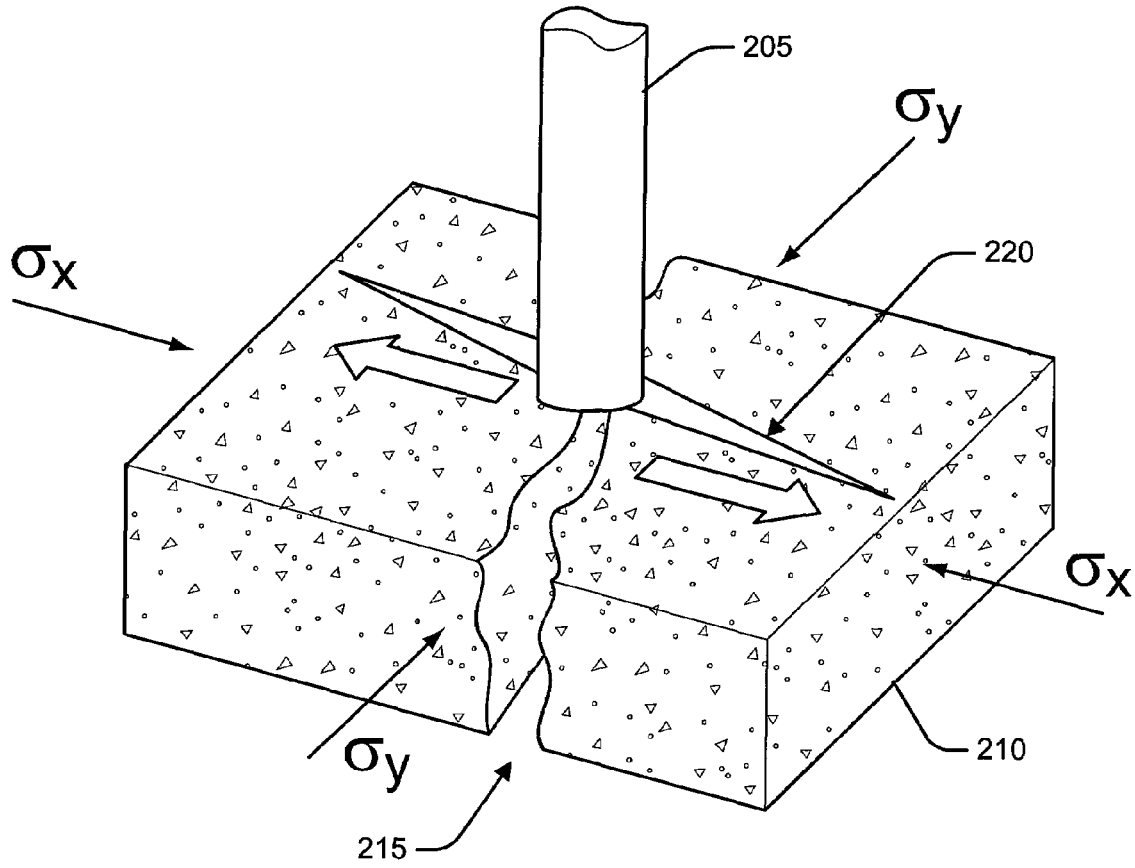
FIG. 2B is a graphical representation of a wellbore in a subterranean formation that has been fractured and the principal stresses on the formation.

FIG. 2B is an illustration the wellbore 205 passing though the formation 210 after a fracture 215 is induced in the formation 210. Assuming for this example that $\sigma_x$ is smaller than $\sigma_y$, the fracture 215 will extend into the y direction, following the minimum stress plane. The orientation of the minimum stress vector direction is, however, in the x direction. As used herein, the orientation of a fracture is defined to be a vector perpendicular to the fracture plane.

As fracture 215 opens, fracture faces are pushed in the x direction. Because formation boundaries cannot move, the rock becomes more compressed, increasing $\sigma_x$. Over time, effects of compression are felt further from the fracture face location. The increased stress in the x direction, $\sigma_x$, quickly becomes higher than $\sigma_y$ causing a change in the local stress direction. When the stimulation process of the first fracture is stopped, the fracture will tend to close as the rock moves back to its original shape, especially due to the increased $\sigma_x$. Even after the fracture is closed, the presence of propping agents that are placed in the first fracture to keep the fracture at least partially open causes stresses in the x direction. These stresses in the formation cause a subsequent fracture (e.g., the second fracture) to propagate in a new direction shown by projected fracture 220. These stresses will be kept even at a higher level due to the latency of stresses due to the Maxwell creep or pseudo-Maxwell creep. The present disclosure is directed to initiating fractures, such as projected fracture 220, while the stress field in the formation 210 is temporarily altered by an earlier fracture, such as fracture 215.

Figure 3:
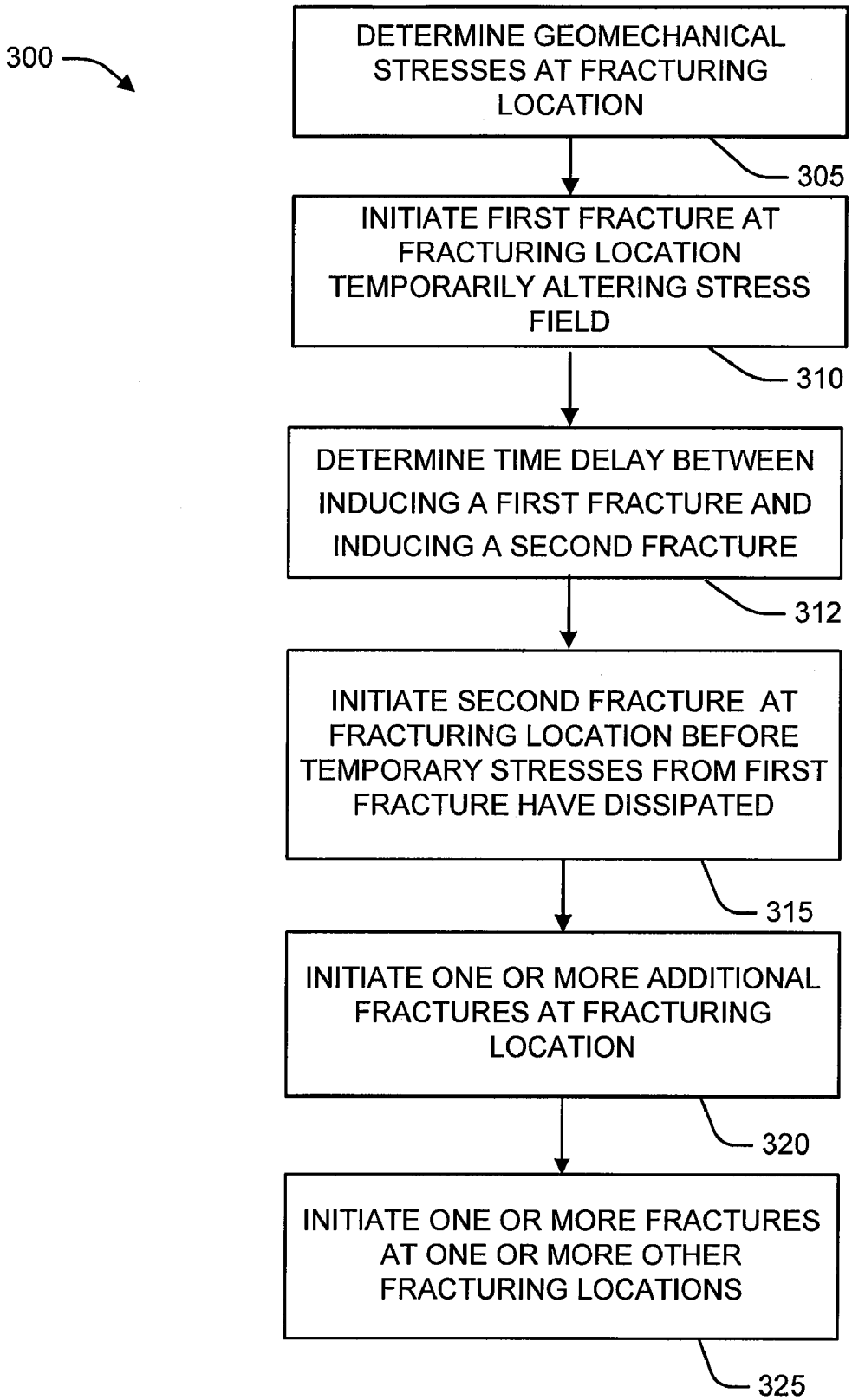
FIG. 3 is a flow chart illustrating an example method for fracturing a formation according to the present invention.

FIG. 3 is a flow chart illustration of an example implementation of one method of the present invention, shown generally at 300. The method includes determining one or more geomechanical stresses at a fracturing location in step 305. In some implementations, step 305 may be omitted. In some implementations, this step includes determining a current minimum stress direction at the fracturing location. In one example implementation, information from tilt meters or micro-seismic tests performed on neighboring wells is used to determine geomechanical stresses at the fracturing location. In some implementations, geomechanical stresses at a plurality of possible fracturing locations are determined to find one or more locations for fracturing. Step 305 may be performed by the control unit 135 by computer with one or more processors and associated data storage.

The method 300 further includes initiating a first fracture at about the fracturing location in step 310. The first fracture's initiation is characterized by a first orientation line. In general, the orientation of a fracture is defined to be a vector normal to the fracture plane. In this case, the characteristic first orientation line is defined by the fracture's initiation rather than its propagation. In certain example implementations, the first fracture is substantially perpendicular to a direction of minimum stress at the fracturing location in the wellbore.

The initiation of the first fracture temporarily alters the stress field in the subterranean formation, as discussed above with respect to FIGS. 2A and 2B. The duration of the alteration of the stress field may be based on factors such as the size of the first fracture, rock mechanics of the formation, the fracturing fluid seeping into the formation, and subsequently injected proppants, if any. There is some permanency to the effects caused from injected proppants. Unfortunately, as the fracture closes the final residual effect attributed to the proppant bed is just a couple of millimeters frac face movement and may be less. Due to the temporary nature of the alteration of the stress field in the formation, there is a limited amount of time for the system to initiate a second fracture at about the fracturing location before the temporary stresses alteration has dissipated below a level that will result in a subsequent fracture at the fracturing being usefully reoriented.

A time delay between the induction of the first fracture and the second fracture may be necessary to increase the fracture length of the second fracture. After initiating a first fracture at a fracturing location in step 310, the method includes determining a time delay between inducing a first fracture and inducing a second fracture (block 312). In certain example implementations, during the fracturing process, one or more effects and characteristics of the fracturing process are measured. These measured effects and characteristics for a particular fracturing process may differ according to the type of affected layer of the formation. These measurements may be used to determine the time delay in step 312. In certain implementations, shear effects between affected layers are used to determine the time delay in step 312. The time delay is determined from the creep velocity in a material exposed to stress. In hard rock, the Maxwell type creep phenomenon is very slow or even essentially non-existent in certain stimulations. The Maxwell phenomenon assumes that all material has an ability to deform over time. This movement, or deformation, is characterized by a conventional well-known relationship of viscosity—assuming that rock, for instance, is a viscous Newtonian fluid with viscosities with an order of magnitude of millions Poise. In comparison, water has a viscosity of 1 centi-Poise. The relationship is generally defined as Shear rate=du/dy=Shear Stress/viscosity. With a viscosity of millions, the shear rate is infinitesimally small.

Figure 16:
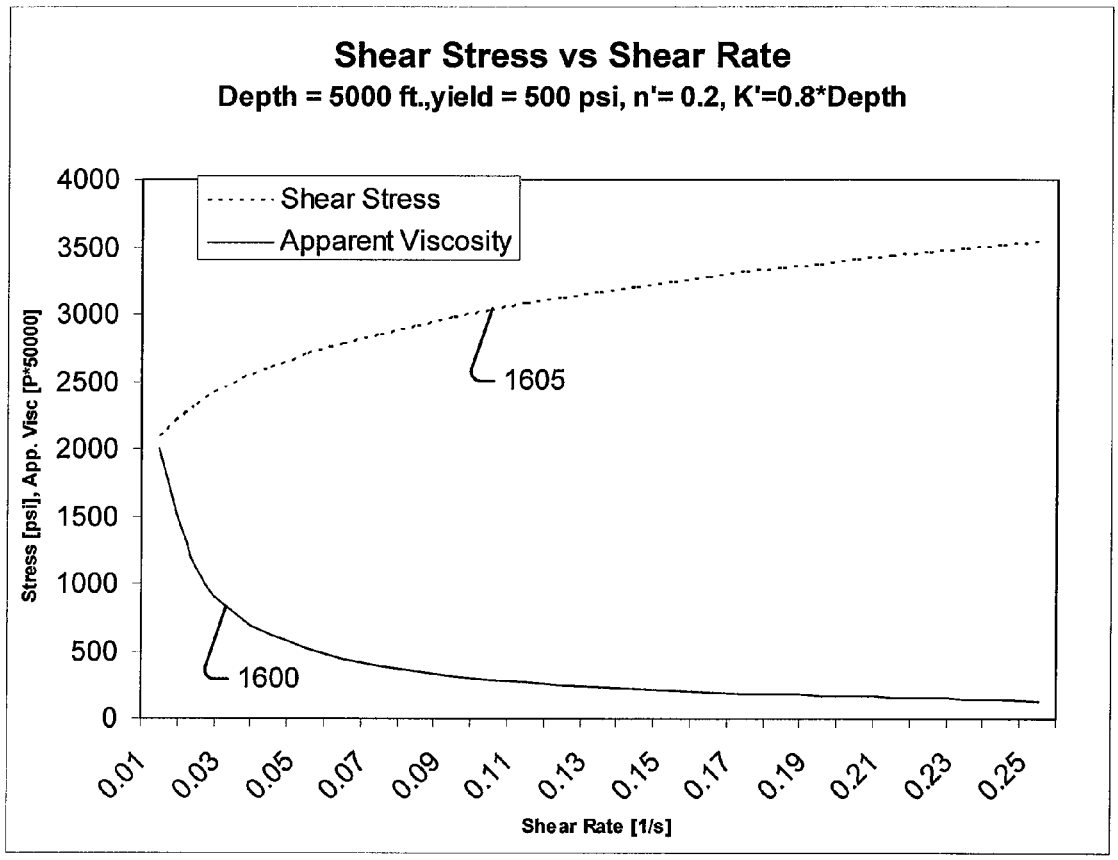
FIG. 16 is a graphical representation depicting typical shear stress and viscosity of a rock formation as a function of shear rate.

Using the shearing phenomenon between layers, a pseudo-Maxwell creep phenomenon can be observed. When the shear stress is sufficiently large, then a "Mode II Sliding Fault" occurs. During this time, a small portion of the fault faces "sticks" to each other; while another portion "slips"—a main basis of the "stick-slip" theory. The sticking process is based on a dry friction model, and is therefore much larger than the slip process. This means that the stick-slip scenario can be approximated as "thixotrophic fluid," with certain "out-of-limit" n' K' values. The Herschel-Bulkley relationship may therefore be used in the assumptions to compute the shear stresses as a function of different shear rates between the slip faces. The following relationship may be used: Shear Stress–Initial Shear Rate+K'*(Shear Rate)^n'. As an example, FIG. 16 depicts Shear Stress versus Shear Rate for a slip plane located at a depth of 5000 ft., and selecting K'=0.8*depth, and n'=0.2, and initial shear equals 500 psi. The apparent viscosity 1600 at every shear rate may be computed using this "Newtonian" relationship. Shear stress 1605 is also plotted. The initial viscosity of the rock is approximately equal to 100 million Poise. This initial viscosity drops rapidly with velocity to about 5 million Poise.

The Maxwell creep relationship is more adaptable to soft rocks as such material is essentially liquefied. Even in such a situation, however, the particle size is generally large. During the movement process, some amount of stick-slip occurs. The stick-slip process in this example may be envisioned as balls (the large particle) jumping over other balls. The use of the Herschel-Bulkley approach would therefore be applicable directly since this process can be approximated to be a thixotropic behavior. As before, the "out of limit" n' K' values may be defined and the Herschel Bulkley relation may be used to compute the shear stress as a function of shear rate.

The time delay computations may largely depend upon the integration of the shear rates over the complete height of the fracture with respect to the displacement of the fracture face and the time during which fracture is being extended and fracture faces being pushed away from each other. This computation will result in the location of the maximum stress at the maximum extension point, as show in FIG. 15, at the time pumping of the first fracture is stopped.

In another embodiment, determination of a time delay between a first fracture and a second fracture is based, at least on in part, on evaluating the effects of closure of the first fracture after the first fracture stimulation has ceased. The effects of closure of the first fracture include, for example, one or more of stick-slip between the affected layers, Maxwell creep effects of the affected layers, pseudo-Maxwell creep effects of the affected layers, lapse of time between initiating the first fracture and closure of the first fracture, the maximum stress location at the maximum extension point caused by the first fracture during the outward direction of the fracture effects, and length duration of time as the stresses drop inwardly and outwardly. Maxwell creep is a plastic function that assumes that a formation is a liquid characterized by a viscosity. Maxwell creep may also be modeled in a pseudo-Maxwell domain, which assumes that a formation has a pseudo-plasticity. The concept of pseudo-plasticity considers letting a formation crack and then modeling the crack as a viscous element, with layers of the formation moving against each other. In a pseudo-Maxwell modeling domain the formation layers moving against each other react as a plastic element. One skilled in the art may also use ductility/pseudo ductile and malleability/malleable/pseudo-malleable characteristics of the formation in the same manner as pseudo-Maxwell creep for determination of the time delay.

Figure 15:
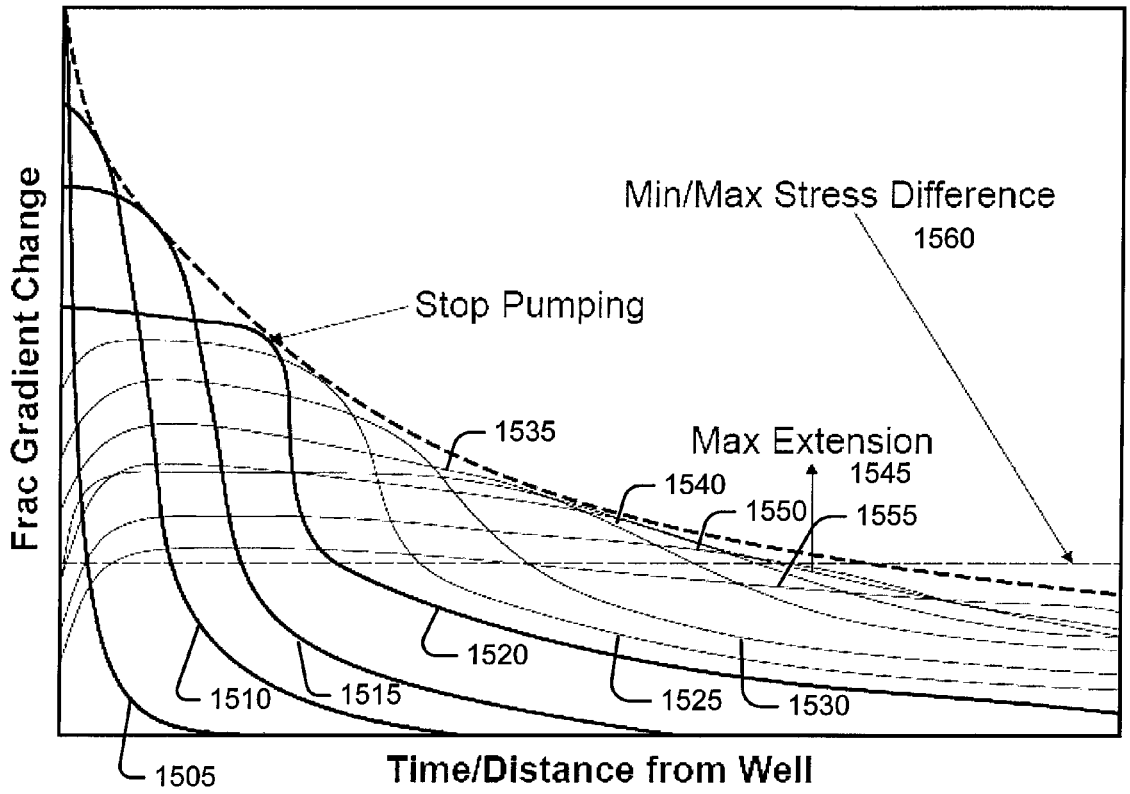
FIG. 15 is a graphical representation of maximizing the second fracture length based on the first fracture gradient change.

In another implementation, the time delay determination may be based at least in part on determining when stress direction modification at the wellbore drops below a stress differential between minimum stress and maximum stress, to provide a maximum time delay for inducing the second fracture. At the maximum time delay, a second fracture may be initiated as shown in FIG. 15.

Yet another example time delay determination is based, at least in part, on when stress direction modification drops below the stress differential between minimum and maximum levels in the area of the tip. During this time, fracture tip velocity is simulated. To optimize the length of the second fracturing, the second fracture tip should not advance beyond the outward stick-slip or creep front created by the first fracture. Based on the fracture tip velocity, the pumping of treatment fluid may be controlled to prevent the fracture tip of the second fracture from advancing beyond a stick-slip front of the first fracture or a Maxwell creep front of the first fracture.

In another example implementation, the time delay is determined, at least in part, on one or more fracture opening effects of the affected layers. The fracture opening effects may be based upon localized fracture gradient changes of the first fracture or dilatancy of the affected layers.

In one example implementation, movement of the wavefront caused by the first fracture is monitored. In certain example implementations, the time delay is determined based, at least in part, on the velocity and intensity of the wavefront data of the first fracture. In some example implementations, one or more tilt meters or microseismic receivers are used to obtain one or more of the velocity and intensity of the first fracture wavefront. The data received from the one or more tilt meters and microseismic receivers may be transmitted in real-time by use of telemetry or SatCom approaches.

In certain example implementations, the time delay is determined based, at least in part, by monitoring closure of the first fracture. Closure at the mouth of the first fracture is especially useful in determining the total time delay that needs to be considered. In some implementations, the closure time, which could be very long or reasonably short, is added to the total delay time. Again, one or more tilt meters or microseismic receivers may be used independently or in combination to obtain closure of the first fracture data.

In yet another example implementation, extension and expansion velocity of the first fracture are monitored. The time delay may then be determined based, at least in part, on the expansion velocity and extension of the first fracture.

Therefore, in step 315 a second fracture is initiated at about the fracturing location before the temporary stresses from the first fracture have dissipated. In some implementations, the first and second fractures are initiated within 24 hours of each other. In other example implementations, the first and second fractures are initiated within four hours of each other. In still other implementations, the first and second fractures are initiated within an hour of each other.

The initiation of the second fracture is characterized by a second orientation line. The first orientation line and second orientation lines have an angular disposition to each other. The plane that the angular disposition is measured in may vary based on the fracturing tool and techniques. In some example implementations, the angular disposition is measured on a plane substantially normal to the wellbore axis at the fracturing location. In some example implementations, the angular disposition is measured on a plane substantially parallel to the wellbore axis at the fracturing location.

In some example implementations, step 315 is performed using a fracturing tool 125 that is capable of fracturing at different orientations without being turned by the drive unit 130. Such a tool may be used when the downhole conveyance 120 is coiled tubing. In other implementations, the angular disposition between the fracture initiations is cause by the drive unit 130 turning a drillstring or otherwise reorienting the fracturing tool 125. In general there may be an arbitrary angular disposition between the orientation lines. In some example implementations, the angular orientation is between 45° and 135°. More specifically, in some example implementations, the angular orientation is about 90°. In still other implementations, the angular orientation is oblique.

In step 320, the method includes initiating one or more additional fractures at about the fracturing location. Each of the additional fracture initiations are characterized by an orientation line that has an angular disposition to each of the existing orientation lines of fractures induced at about the fracturing location. In some example implementations, step 320 is omitted. Step 320 may be particularly useful when fracturing coal seams or diatomite formations.

Figure 4:
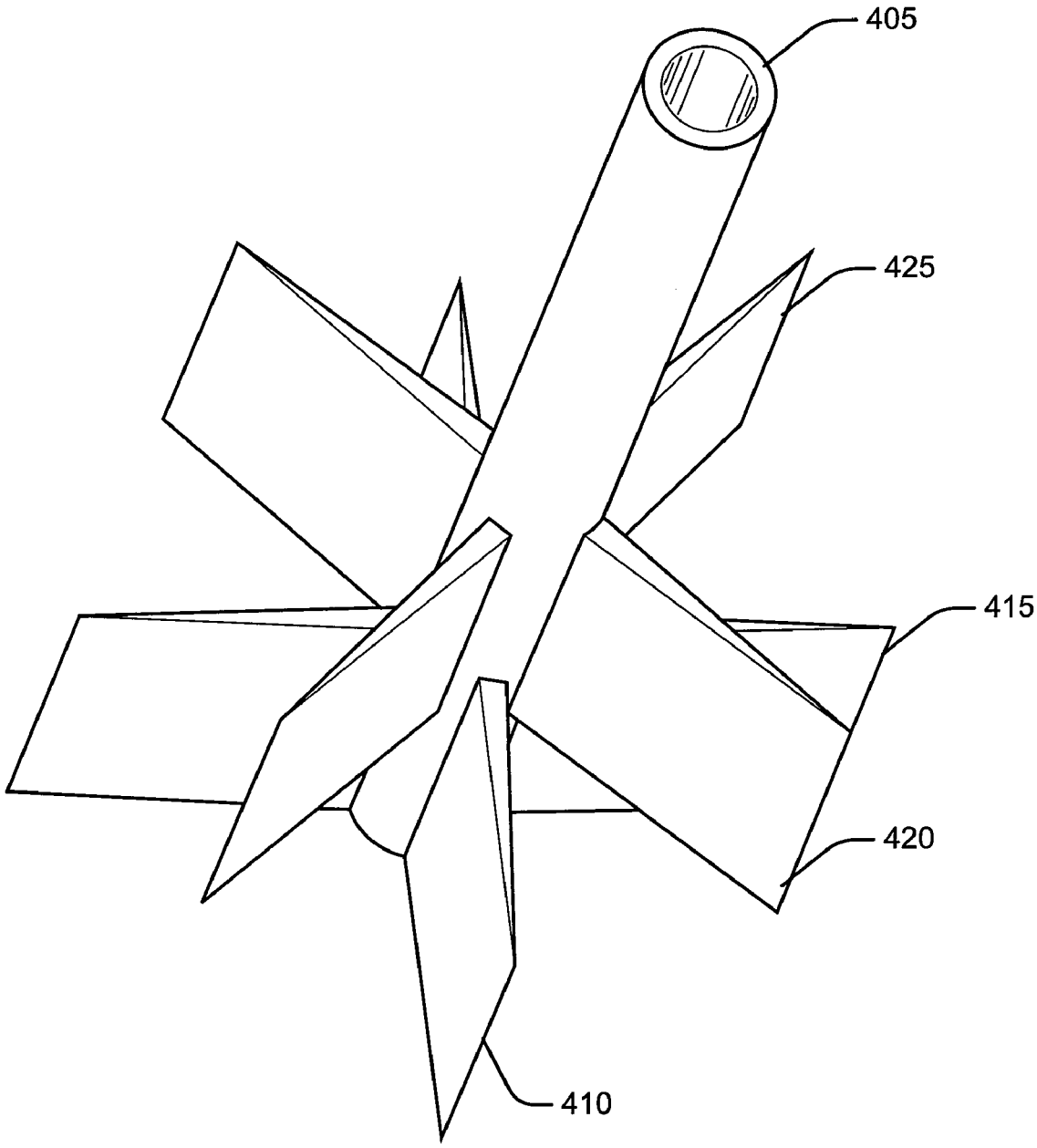
FIG. 4 is a graphical representation of a wellbore and multiple fractures at different angles and fracturing locations in the wellbore.

The fracturing tool may be repositioned in the wellbore to initiate one or more other fractures at one or more other fracturing locations in step 325. For example, steps 310, 315, and optionally 320 may be performed for one or more additional fracturing locations in the wellbore. An example implementation is shown in FIG. 4. Fractures 410 and 415 are initiated at about a first fracturing location in the wellbore 405. Fractures 420 and 425 are initiated at about a second fracturing location in the wellbore 405. In some implementations, such as that shown in FIG. 4, the fractures at two or more fracturing locations, such as fractures 410-425, and each have initiation orientations that angularly differ from each other. In other implementations, fractures at two or more fracturing locations have initiation orientations that are substantially angularly equal. In certain implementations, the angular orientation may be determined based on geomechanical stresses about the fracturing location.

Figure 5:
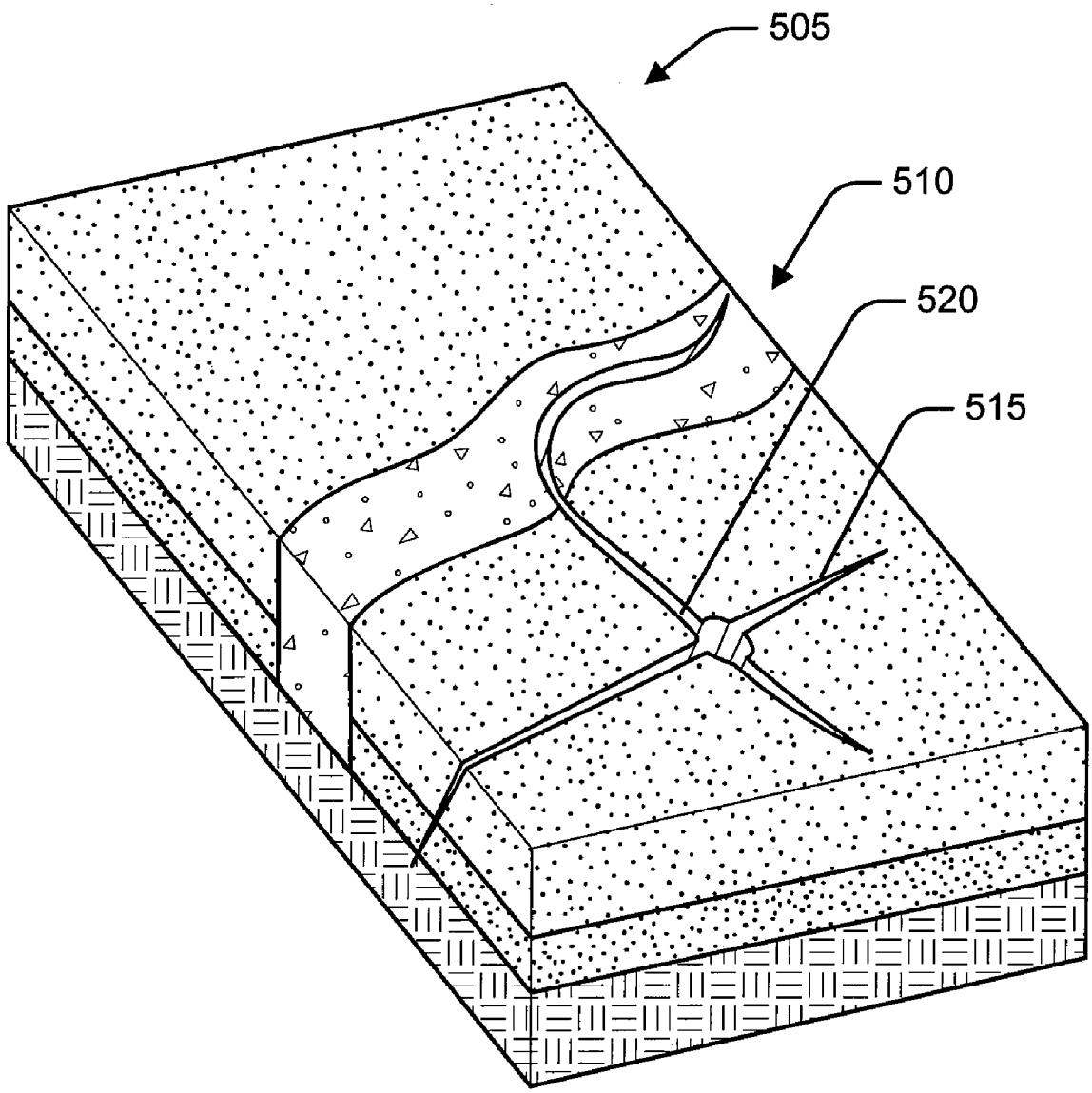
FIG. 5 is a graphical representation of a formation with a high-permeability region with two fractures.

FIG. 5 is an illustration of a formation 505 that includes a region 510 with increased porosity or permeability, relative to the other portions of formation 505 shown in the figure. In this method it is assumed that more porous rock formations are more permeable. However, it is noted that in actual formations, that is not always the case. When fracturing to increase the production of hydrocarbons, it is generally desirable to fracture into a region of higher permeability, such as region 510. The region of high permeability 510, however, reduces stress in the direction toward the region 510 so that a fracture will tend to extend in parallel to the region 510. In the fracturing implementation shown in FIG. 5, a first fracture 515 is induced substantially perpendicular to the direction of minimum stress. The first fracture 515 alters the stress field in the formation 505 so that a second fracture 520 can be initiated in the direction of the region 510. Once the fracture 520 reaches the region 510 it may tend to follow the region 510 due to the stress field inside the region 510. In this implementation, the first fracture 515 may be referred to as a sacrificial fracture because its main purpose was simply to temporarily alter the stress field in the formation 505, allowing the second fracture 520 to propagate into the region 510. Even though first fracture 515 is referred to as a sacrificial fracture, in present day technology prior to using this technique, first fracture 515 is the result of a conventionally placed fracture; thus offering conventional level of benefits.

Figure 6:
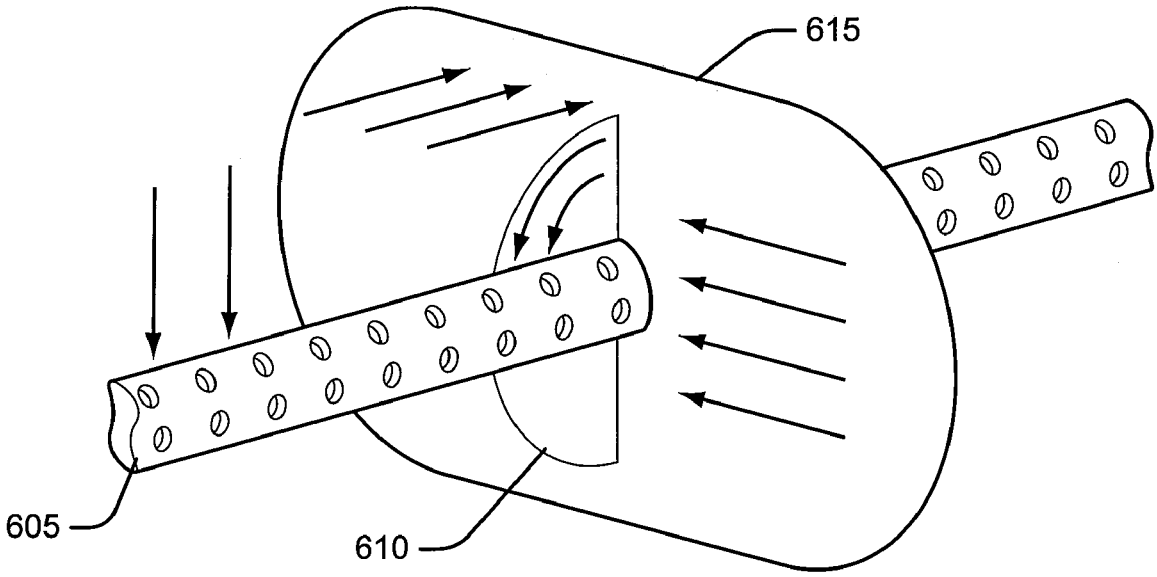
FIG. 6 is a graphical representation of drainage into a horizontal wellbore fractured at different angular orientations.

FIG. 6 illustrates fluid drainage from a formation into a horizontal wellbore 605 that has been fractured according to method 100. In this situation, the effective surface area for drainage into the wellbore 605 is increased substantially by fracture 615. However, production flow through this fracture has to travel radially to the wellbore, thus creating a massive constriction at the wellbore. In the example shown in FIG. 6, a second, smaller fracture is created allowing fluid flow along plane 610 and fracture 615 are able to enter the wellbore 605. In addition, flow in fracture 615 does not have to enter the wellbore radially. FIG. 6 also shows flow entering the fracture 615 in a parallel manner; which then flows through the fracture 615 in a parallel fashion into fracture 610. This scenario causes very effective flow channeling into the wellbore.

Figure 8:
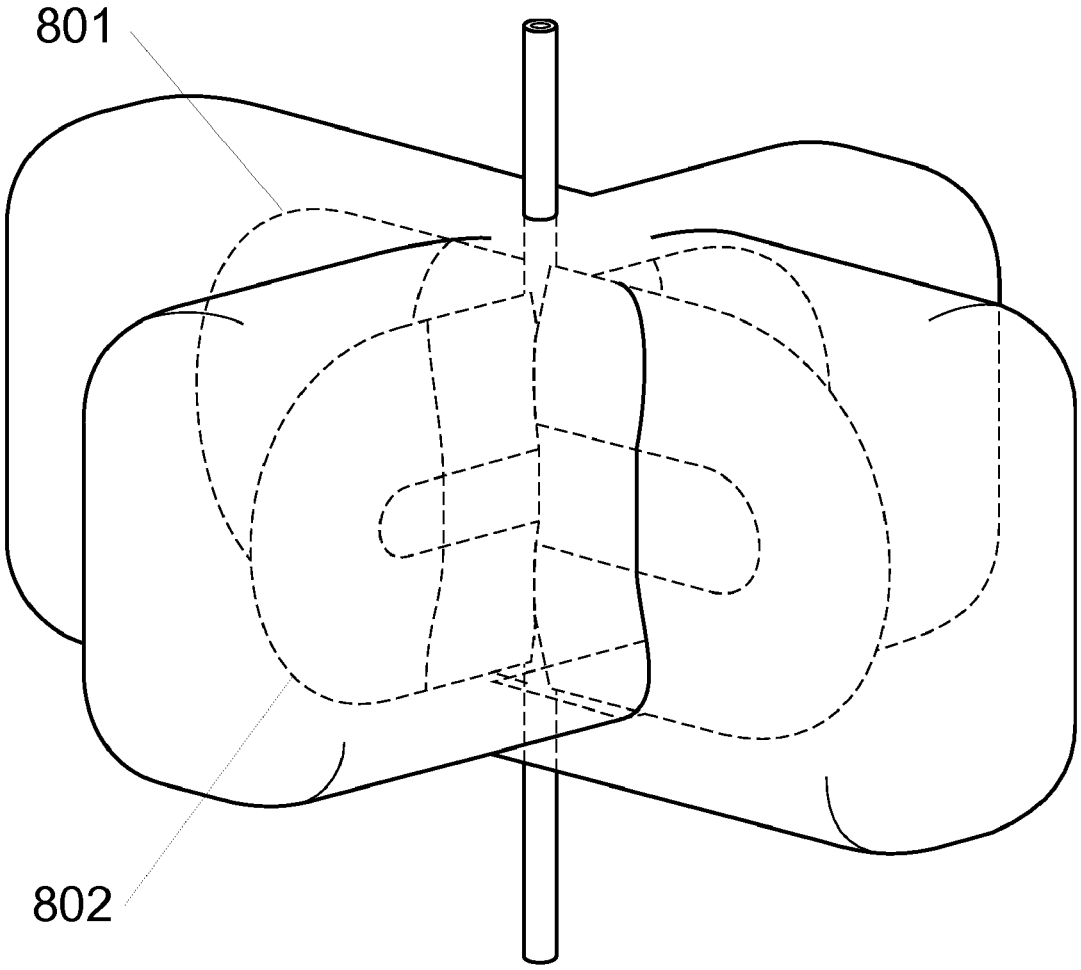
FIG. 8 is a graphical representation of the drainage of a vertical wellbore fractured at different angular orientations.

In general, additional fractures, regardless of their orientation, provide more drainage into a wellbore. Each fracture will drain a portion of the formation. Multiple fractures having different angular orientations, however, provide more coverage volume of the formation, as shown by the example drainage areas 801 and 802 illustrated in FIG. 8. The increased volume of the formation drained by the multiple fractures with different orientations may cause the well to produce more fluid per unit of time.

Figure 7A:
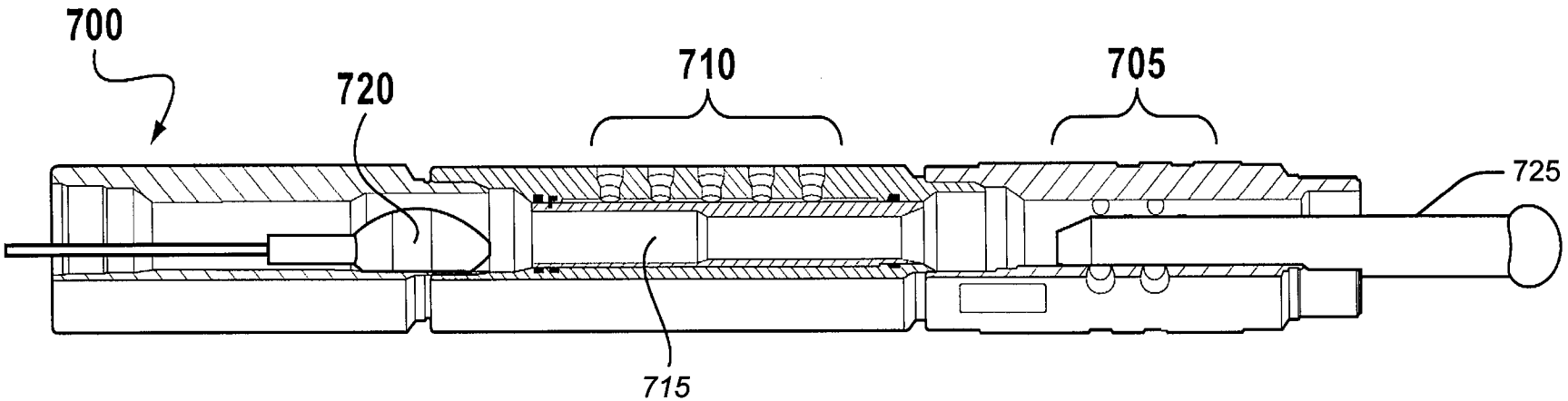
FIGS. 7A, 7B, and 7C illustrate a cross-sectional view of a fracturing tool showing certain optional features in accordance with one example implementation.
Figure 7B:
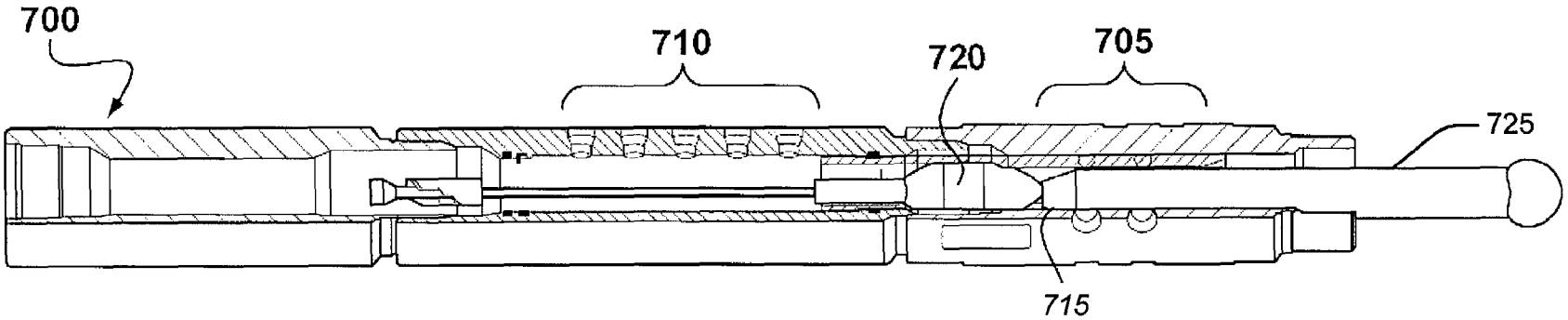
Figure 7C:
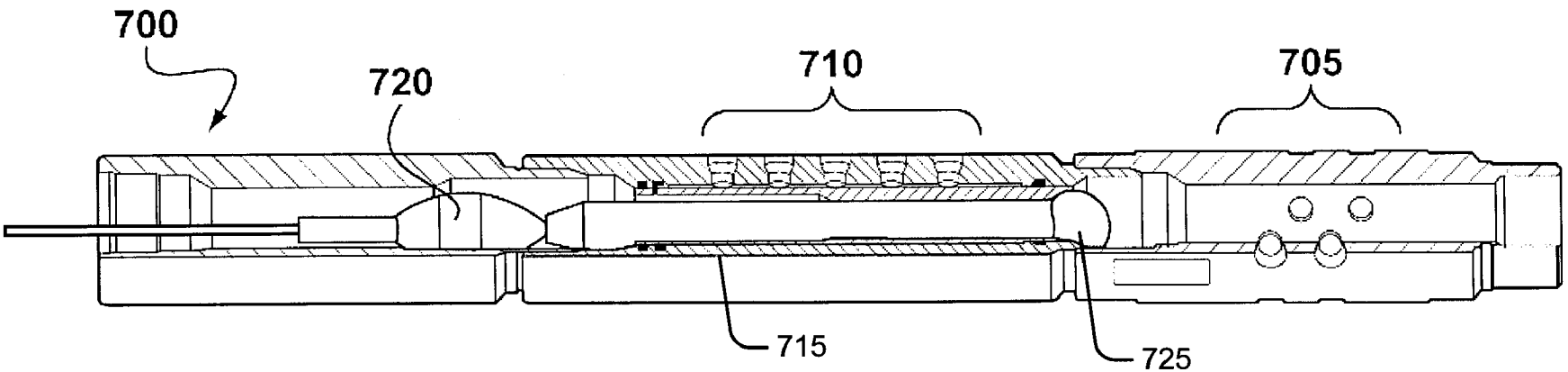

A cut-away view of an example fracturing tool 125, shown generally at 700, that may be used with method 300 is shown in FIGS. 7A-7C. The fracturing tool 700 includes at least two fracturing sections, such as fracturing sections 705 and 710. Each of sections 705 and 710 are configured to fracture at an angular orientation, based on the design of the section. In one example implementation, fluid flowing from section 710 may be oriented obliquely, such as between 45° to 90°, with respect to fluid flowing from section 705. In another implementation fluid flow from sections 705 and 710 are substantially perpendicular.

The fracturing tool includes a selection member 715, such as sleeve, to activate or arrest fluid flow from one or more of sections 705 and 710. In the illustrated implementation selection member 715 is a sliding sleeve, which is held in place by, for example, a detent. While the selection member 715 is in the position shown in FIG. 7A, fluid entering the tool body 700 exits though section 705.

A valve, such as ball valve 725 is at least partially disposed in the tool body 700. The ball valve 725 includes an actuating arm allowing the ball valve 725 to slide along the interior of tool body 700, but not exit the tool body 700. In this way, the ball valve 725 prevents the fluid from exiting from the end of the fracturing tool 125. The end of the ball value 725 with actuating arm may be prevented from exiting the tool body 700 by, for example, a ball seat (not shown).

The fracturing tool further comprises a releasable member, such as dart 720, secured behind the sliding sleeve. In one example implementation, the dart is secured in place using, for example, a J-slot.

In one example implementation, once the fracture is induced by sections 705, the dart 720 is released. In one example implementations, the dart is released by quickly and briefly flowing the well to release a j-hook attached to the dart 725 from a slot. In other example implementations, the release of the dart 720 may be controlled by the control unit 135 activating an actuator to release the dart 720. As shown in FIG. 7B, the dart 720 causes the selection member 715 to move forward causing fluid to exit though section 710.

As shown in FIG. 7C, the ball value 725 with actuating arm may reset the tool by forcing the dart 720 back into a locked state in the tool body 700. The ball value 725 also may force the selection member 715 back to its original position, before fracturing was initiated. The ball value 725 may be forced back into the tool body 700 by, for example, flowing the well.

Figure 9:
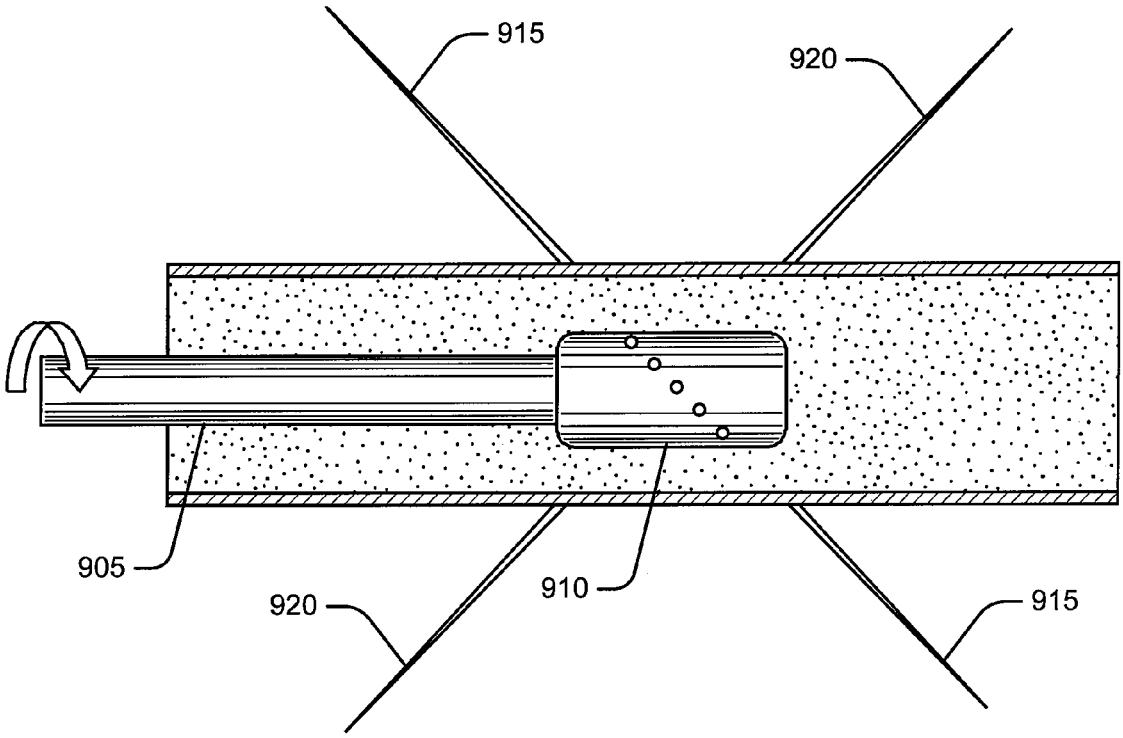
FIG. 9 is a graphical representation of a fracturing tool rotating in a horizontal wellbore and fractures induced by the fracturing tool.

Another example fracturing tool 125 is shown in FIG. 9. Tool body 910 receives fracturing fluid though a drill string 905. The tool body has an interior and an exterior. Fracturing passages pass from the interior to the exterior at an angle, causing fluid to exit from the tool body 910 at an angle, relative to the axis of the wellbore. Because of the angular orientation of the fracturing passages, multiple fractures with different angular orientations may be induced in the formation by reorienting the tool body 910. In one example implementation, the tool body is rotated to reorient the tool body 910 to fracture at different orientations and create fractures 915 and 920. For example, the tool body may be rotate about 180°. In the example implementation shown in FIG. 9 where the fractures 915 and 920 are induced in a horizontal or deviated portion of a wellbore, the drill string 805 may be rotate more than the desired rotation of the tool body 910 to account for friction.

Figure 10A:
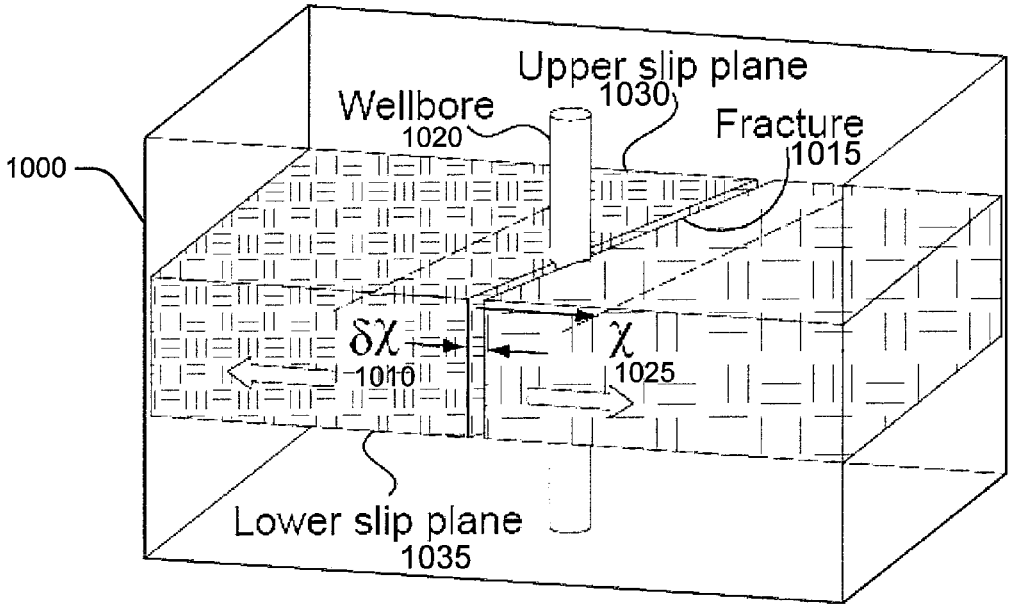
FIG. 10*a* is a graphical representation of fracture generation.

Conventional fracturing does not generally consider the time factor between each subsequent fracture. In fact subsequent fractures are sometimes initiated many hours or even days apart. The plasticity of the formation has also not been considered conventionally as a major factor in the behavior of fracture development in the formation. When plasticity or creep is factored into evaluation of stimulating a well bore, time becomes a major factor as to where a fracture will initiate and extend. FIG. 10*a* illustrates a more realistic "plastic" behavior for fracture generation given formation 1000 with wellbore 1020. As a layer or group of layers in the formation 1000 is being fracture stimulated, the fracture faces will part from each other as shown. As the fracture faces move δX 1010 from each other; the boundary of the layer separates for a distance of X 1025 from the fracture 1015. The rock beyond X 1025 is held by friction on the upper slip plane 1030 and lower slip plane 1035 as shown. At point X 1025, the rock has not moved and hence, compression forces cause the rock to expand upwards; lifting the massive mass above it. After some time, due to plastic creep, the front X 1025 will slowly move to the right; opening the fracture 1015 somewhat while relaxing the overburden stress increase.

Figure 10B:
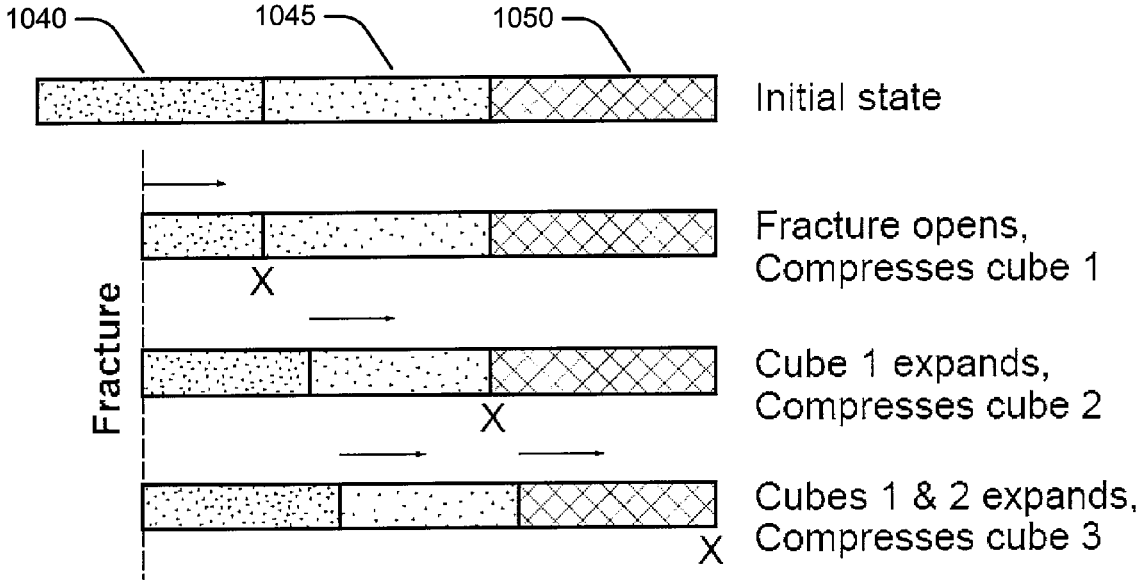
FIG. 10*b* is a graph depicting the compression creep process.

FIG. 10*b* is a graph depicting the compression creep process. A small section of the formation 1000 is divided into three sections, 1040, 1045, and 1050. As the fracture 1015 opens, compression only affects the first section 1040. Front "X" is held in position at that instant. After a first period of time, the second section 1045 begins to compress plastically and quickly followed by shearing of the bond to the bordering formations. The shearing stops just before reaching section 1050. Section 1045 quickly compresses elastically while section 1040 expands accordingly. Similarly, after a second period of time, longer than the first period of time, section 1050 begins to compress plastically. This process repeats itself until no further expansion occurs.

Figure 11:
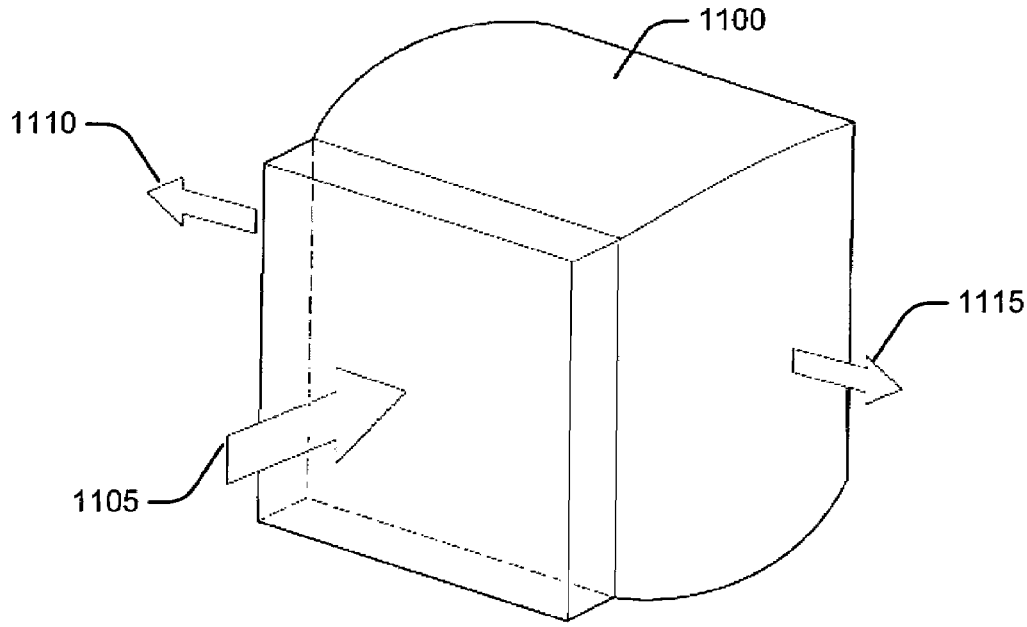
FIG. 11 is a graphical representation of stress redirection by a fracture.
Figure 12:
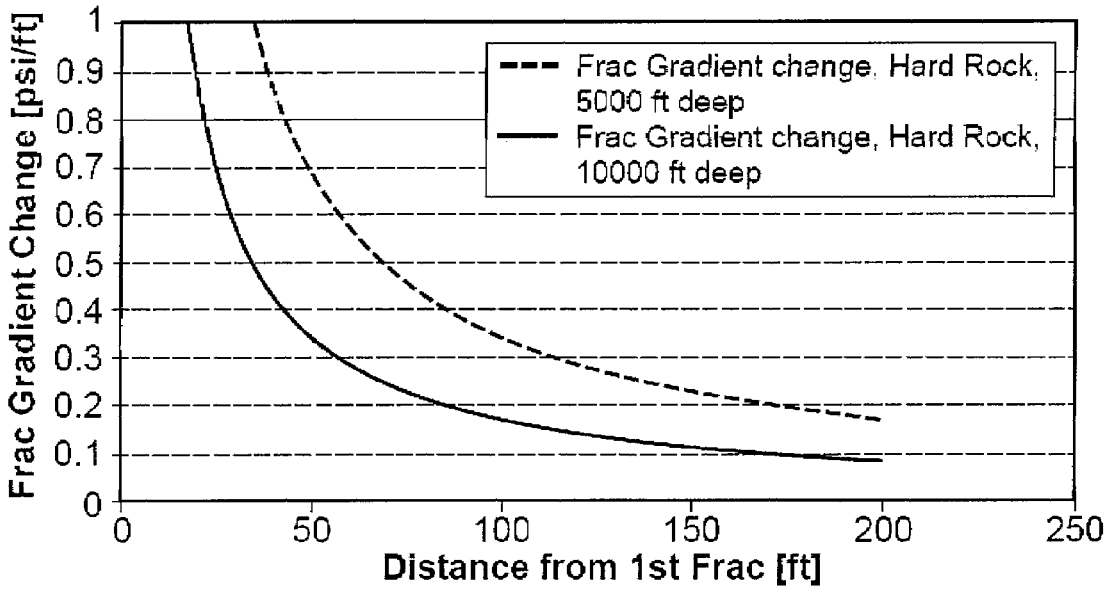
FIG. 12 is a graph depicting fracture gradient change for hard rock.

In general, FIG. 11 depicts stress redirection by a fracture. FIG. 11 shows two phenomena in the process depicted in FIG. 10*a* and FIG. 10*b*. As a fracture (not shown) opens up, the formation 1100 is being compressed directly into the direction of arrow 1105. A smaller amount of compression (as determined by the Poisson's ratio) is directed into the direction of the fracture itself as indicated by arrows 1110 and 1115. The modification of stresses into directions 1110 and 1115 depends upon the compressibility of the formation 1100 itself and is not dependent upon the location of the fracture. Frac gradients are depth dependent. Therefore, modification of frac gradients are inversely dependent to the depth of the fracture. FIG. 12 shows the fracture gradient change for hard rock (with compressibilities of 1.8E-7/psi) for two depths and the direct inverse dependency of the frac gradient effects. For the plots of FIG. 12, the fracture half-length was assumed to be 200 ft. and the fracture width during the stimulation job was 0.75" (prior to closure).

Figure 13:
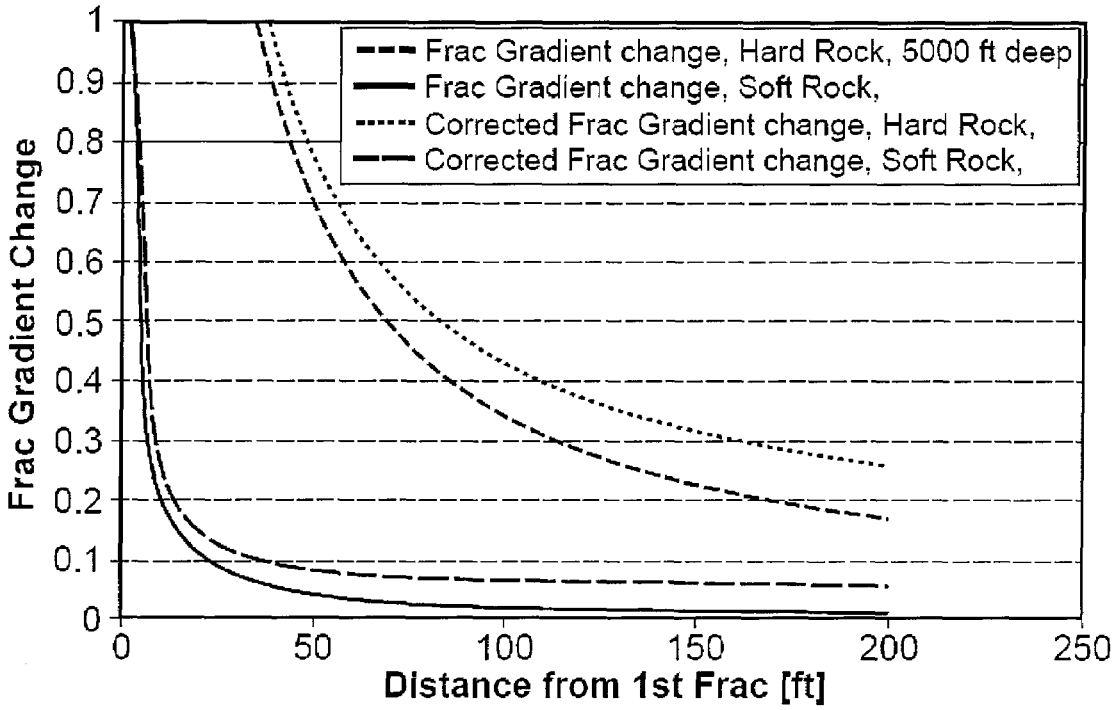
FIG. 13 is a graph depicting corrected stress change.

The second phenomenon that can be described in FIG. 11 is when a second fracture is created perpendicular to the first fracture. As the second fracture opens and extends, as per FIG. 12, the fracture stress gradient differential continues to drop with distance. For example, if the minimum and maximum stress gradients differ by 0.2 and the depth of the fracture is 10,000 ft, at approximately 90 ft the fracture will start to turn into the original fracture direction (parallel to the first fracture). However, based upon FIG. 11, the opening of the second fracture also pushes sideways as indicated by arrow 1105. Again, a smaller amount of creep movement pushes into the direction of the fracture extension as indicated by arrows 1110 and 1115. This latter "minor" push adds the maximum straight fracture extension to a few feet longer than 90 ft., as shown in FIG. 13. For sandstone formations, since it is a dilatant material and it has a volumetric creep less than zero, the "minor" push above extends the fracture even further than the previously discussed rock formations. FIG. 13 shows the added "push" that maintains the fracture to extend somewhat longer into the unnatural minimum stress direction. It should be noted, that stress modification in softer rock is much less than in harder rock. However, stress differentials in softer rocks are also much less than in harder rock. Thus, the effectiveness of this process is equally acceptable in both soft and hard rock applications.

Figure 14:
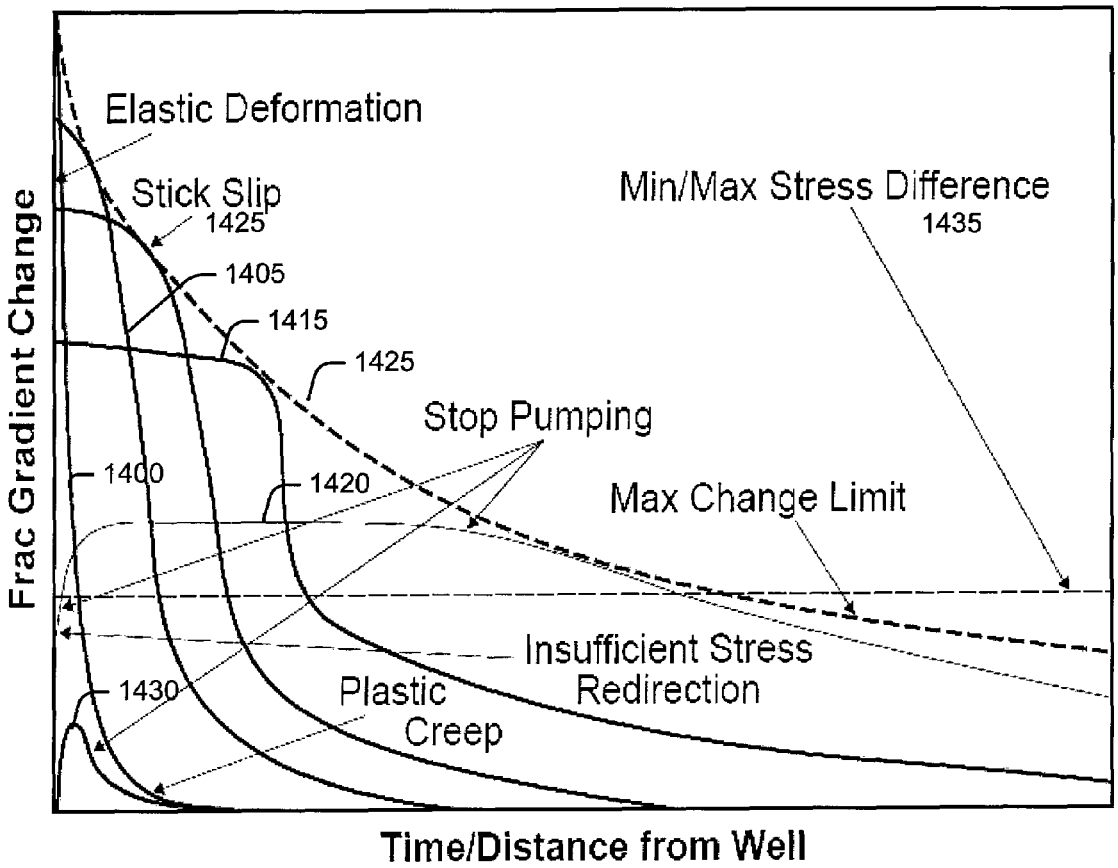
FIG. 14 is a graphical representation of creep effects in fracture development.

Plasticity relates to time. Placement of a 200 ft. fracture takes some time to perform and to allow for some occurrence of plastic creep motion. Even though the true plastic creep takes a much longer time, stick-slip motion can be characterized as behaving like plastic motion. The primary mechanics behind stick-slip motion is purely elastic and hence stick-slip motion occurs at a faster pace than true plastic creep. FIG. 12 shows that the near wellbore fracture gradient change is tremendously high. The fracture gradient change occurs during the hydraulic fracturing process. When pumping stops, the near wellbore opening can collapse so as to rapidly and significantly reduce stresses, as shown in FIG. 14. The horizontal axis and vertical of axis of FIG. 14 are the same as those shown in FIG. 12. The difference between FIG. 12 and FIG. 14 is that the time factor is normalized in order to fit the distance curve perfectly.

FIG. 14 shows that initially frac gradient changes substantially, but also elastically as represented in the first step in FIG. 10(*b*). At this time, the near wellbore rock has not yet deformed plastically, although some plastic deformation occurs throughout a certain distance from the fracture (see the bottom of line 1415). If no time delay is taken for a major plastic deformation to occur and pumping is stopped, the fracture immediately collapses, even though some minor frac gradient change occurs nearby (see line 1430). With time, the deformation front moves away from the wellbore as a result primarily of the stick-slip process as shown by lines 1405, 1410, and 1415. The maximum slip distance can be limited by some "max change limit" which basically represents the true elastic limit for the formation. For example, assume that the stress gradient difference is represented by line 1435 and that the pumping stops at a the time depicted by line 1420. Then, since every position away from the wellbore has been deformed plastically, stress differences remain high with the exception of the near wellbore which drops considerably. This drop could fall below the "Min/Max Stress Difference" level 1435 and hence, fracturing using conventional fracturing processes would re-open the first fracture. However, using a hydrajet fracturing process, deep hydrajetting could cause the perforation to bypass the near-wellbore stress effects and respond to the far-field stress condition.

FIG. 15 is a graphical representation of maximizing the second fracture length based on the first fracture gradient change in order to achieve maximum fracturing. As the first fracture opens (starting from line 1505) the stress effects of the first fracture jump down from the first line 1505 to the right. This is due to the "stick-slip" process plus some of the pure "Maxwell" type creep effects. The stress effects of the first fracture continue to move to the right (lines 1510 through 1540). If pumping is stopped when stresses are as shown by line 1545 and no other fracturing is performed, the stress lines will continue to move to the right while dying off as shown by lines 1550-1555. Observing the Min/Max stress difference (line 1560), it is desirable to start the second fracture on or before the line 1540 condition. As FIG. 15 shows, line 1540 starts crossing the Min/Max difference line 1560. It is theorized, that even though line 1540 is slightly below the Min/Max difference line 1560, when using SurgiFrac techniques, an orthogonal fracture can be created because the method could extend a little beyond the near wellbore condition. The condition depicted by line 1550 is quite too low for any process and the redirection technique will fail. On the other hand, it may be safe to start the second fracture to follow the condition depicted by line 1525. Using the condition depicted by line 1525, however, the second fracture is completed too early resulting in only a short fracture extension before the fracture bends to the natural fracture direction. The conditions depicted in FIG. 15 illustrate that compressional effects translate to upward shift in the rock which provides some condition that is detectable using tilt meters, microseismic receivers, and other equipment known to one skilled in the art. By detecting the upward shift in real time, the extension of the fracture can be sped up or slowed down to provide a maximum length second fracture.

In one embodiment, the second fracture length is less optimized by inducing the second fracture at a time delay from the inducement of the first fracture as shown by line 1540.

In another embodiment obtaining a maximum length fracture for the formation requires inducing the second fracture at a time delay from the inducement of the first fracture as shown by line 1550 in order to achieve maximum extension of the fracture of the formation.

In yet another embodiment, in order to obtain the maximum fracture length the second fracture length is optimized by inducing the second fracture at a time delay from the inducement of the first fracture as shown by line 1540 but then slowing down the fracture tip to wait for the condition depicted by line 1550 to occur.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A computer program, stored in a computer-readable medium, for determining a time delay between initiation of a first fracture and initiation of a second fracture comprising executable instructions that cause at least one processor to:

receive one or more outputs from one or more tilt meters, wherein the one or more tilt meters are configured to measure one or more stress fields of one or more affected layers during opening or closing of the first fracture;

receive one or more outputs from a plurality microseismic receivers, wherein the plurality of microseismic receivers are configured to measure the one or more stress fields of the one or more affected layers during opening or closing of the first fracture; and wherein the time delay is determined based, at least in part, on the one or more stress fields of the one or more affected layers;

where the time delay is a delay between the initiation of the first fracture and the initiation of the second fracture.

2. The computer program of claim 1, further comprising executable instructions that, when executed, cause the one or more processors to:

determine one or more of:

a stick-slip velocity of the one or more affected layers;

a Maxwell creep of the one or more affected layers; and a pseudo-Maxwell creep of the one or more affected layers;

wherein the stick-slip velocity, the Maxwell creep and the pseudo-Maxwell creep are based, at least in part, on the one or more stress fields; and wherein the time delay is based, at least in part, on the one or more of the stick-slip velocity, the Maxwell creep, and the pseudo-Maxwell creep.

3. The computer program of claim 1, further comprising executable instructions that, when executed, cause the one or more processors to:

determine a lapse of time between initiation of the first fracture and closure of the first fracture;

determine a length of fracture of the first fracture in an outward direction; and determine a length of the first fracture in an inward direction;

wherein the time delay between initiation of a first fracture and initiation of a second fracture is based, at least in part, on one or more of the lapse of time between initiation of the first fracture and closure of the first fracture, the length of fracture of the first fracture in an outward direction, and the length of the first fracture in an inward direction.

4. The computer program of claim 1, further comprising executable instructions that, when executed, cause the one or more processors to:

determine a stress change of a wavefront of the first fracture, based, at least in part, on the one or more stress fields; and wherein the time delay is determined based, at least in part, on the stress change of the wavefront of the first fracture.

5. The computer program of claim 1, further comprising executable instructions that, when executed cause the one or more processors to:

monitor an extension of the first fracture;

monitoring an expansion velocity of the first fracture; and wherein the time delay is determined based, at least in part, on the extension of the first fracture and the expansion velocity of the first fracture.

6. The computer program of claim 1, further comprising executable instructions that, when executed, cause the one or more processors to:

simulate a fracture tip velocity of the second fracture; and controlling pumping of treatment fluid based, at least in part, on the fracture tip velocity so as to prevent a fracture tip of the second fracture from advancing beyond a stick-slip front of the first fracture or a Maxwell creep front of the first fracture.

7. The computer program of claim 1, further comprising executable instructions that, when executed, cause the one or more processors to:

control fracture extension velocity of the first fracture; and control fracture extension velocity of the second fracture.

* * * * *